US006796116B2

(12) United States Patent
Raasch

(10) Patent No.: US 6,796,116 B2
(45) Date of Patent: Sep. 28, 2004

(54) SLIVER OPENING DEVICE FOR AN OPEN-END SPINNING DEVICE

(75) Inventor: Hans Raasch, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 126 days.

(21) Appl. No.: 10/199,824

(22) Filed: Jul. 19, 2002

(65) Prior Publication Data

US 2003/0014957 A1 Jan. 23, 2003

(30) Foreign Application Priority Data

Jul. 20, 2001 (DE) ..... 101 35 548

(51) Int. Cl.[7] ..... D01H 4/00; D01H 5/70
(52) U.S. Cl. ..... 57/412; 57/400; 57/328
(58) Field of Search ..... 57/400, 401, 402, 57/403, 404, 408, 409, 410, 411, 412, 112; 19/150, 157, 65 A, 65 CR

(56) References Cited

U.S. PATENT DOCUMENTS

| | | | | |
|---|---|---|---|---|
| 3,107,447 A | * | 10/1963 | Meimberg | 57/400 |
| 3,748,695 A | * | 7/1973 | Shino et al. | 19/293 |
| 4,050,228 A | * | 9/1977 | Landwehrkamp et al. | 57/412 |
| 4,369,622 A | | 1/1983 | Teed et al. | 57/315 |
| 4,676,062 A | | 6/1987 | Brockmanns et al. | 57/400 |
| 4,866,926 A | | 9/1989 | Safar et al. | 57/408 |
| 4,979,270 A | * | 12/1990 | Morrison et al. | 19/0.6 |
| 5,699,659 A | * | 12/1997 | Caviness | 57/245 |
| 5,890,356 A | | 4/1999 | Stahlecker | 57/401 |
| 6,368,444 B1 | * | 4/2002 | Jameson et al. | 156/229 |
| 6,673,297 B2 | * | 1/2004 | Mushaben | 264/288.4 |

FOREIGN PATENT DOCUMENTS

| | | | | |
|---|---|---|---|---|
| DE | 32 19 332 A1 | | 11/1983 | |
| DE | 3245517 A1 | * | 6/1984 | D01H/5/24 |
| DE | 38 19 403 A1 | | 12/1988 | |
| DE | 40 40 102 A1 | | 6/1992 | |
| DE | 34 02 083 C2 | | 3/1995 | |
| DE | 196 10 960 A1 | | 9/1997 | |

OTHER PUBLICATIONS

German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

An open-end spinning device with an opening device for opening continuously supplied sliver material by means of a rapidly running opening cylinder, which opening device is arranged in front of a sliver spreading device (78) with cooperating pairs of spreading cylinders. The spreading cylinders (79, 80, 81, 82) comprise flanges that engage into recesses of the opposing spreading cylinder. The spacing between the particular cooperating spreading cylinders (79, 80, 81, 82) can be periodically varied. An unobjectionable opening process with a low speed of the opening cylinder and with a widened opening cylinder can be achieved with the sliver spreading device (78) of the invention which process is associated with a high-precision dosing and high yarn uniformity.

10 Claims, 5 Drawing Sheets

SLIVER OPENING DEVICE FOR AN OPEN-END SPINNING DEVICE

CROSS-REFERENCES TO RELATED APPLICATIONS

This application claims the benefit of German patent application 10135548.3, filed Jul. 20, 2001, herein incorporated by reference.

BACKGROUND OF THE INVENTION

The present invention relates generally to open-end spinning devices and, more particularly, to a sliver opening device for an open-end spinning device which comprises a feed device for a rapidly running opening cylinder for opening continuously supplied sliver material.

In addition to the rotor spinning method, a sliver is opened by an opening cylinder into individual fibers in other open-end spinning methods such as friction spinning or air spinning. It is customarily desired in such spinning methods in order to avoid fiber compressions that the sliver material be constantly accelerated over its entire path from the feed device of the opening cylinder to the yarn withdrawal device without the draw-off speed having to assume values that are too high. However, lowering the speed of the opening cylinder as desired for this purpose can be associated with significant disadvantages. There is the danger when the speed of the opening cylinder is lowered that the opening function is adversely affected to a significant extent. The number of interventions of opening elements such as needles or sawteeth into the sliver tuft that are necessary for the desired opening of the sliver material into individual fibers can not be achieved. Both the amount of the combed-out fibers as well as the invariability of this amount is insufficient for an unobjectionable yarn.

German Patent Publication DE 40 40 102 A1 shows a device for spinning a yarn in which device the sliver end is moved into the fittings by an additional airflow so that an effective opening should be possible even if the speed of the opening cylinder is significantly reduced relative to the speed of opening cylinders customary in rotor spinning devices. Because the sliver end is pressed into the fittings, the combing out of fibers, which is substantially brought about by the side flanks of the teeth or needles, is intensified. The attempt is made in this manner to generate a sufficient frictional entrainment even in the case of rather slower combing speeds, which entrainment reliably draws the fibers out of the sliver end or tuft. However, it turned out that as a result of the aspirated drawing in of the individual fibers, the latter are transported with the circumferential speed of the opening cylinder so that, in spite of the reduced circumferential speed of the opening cylinder, the individual fibers have on the whole the same speed as in the case of traditional opening cylinders and are thus undesirably rapid.

German Patent Publication DE 196 10 960 A1 also describes an open-end spinning method in which the individual fibers should no longer be slowed down on their way from the sliver to the yarn. The individual fibers should be subjected immediately after they have been loosened out of the sliver to a precisely determined, mechanically controlled speed. The feed device comprises a very wide feed cylinder and an opening cylinder that is just as wide. This method allows the number of interventions of opening elements into the sliver tuft to be increased.

Presenting multiple slivers, e.g., five slivers, adjacent to each other at the same time is disclosed as a possibility for achieving a wide presentation of fibers. The feeding of several slivers to a spinning location results in significant expense. For example, in addition to the expense occasioned by a multiplication of the feed paths with the required feed elements, the space for a corresponding number of spinning cans at each spinning location must be available. This results in an enormous space requirement for a spinning machine with its plurality of spinning locations. Moreover, very high drafts result between the sliver feed and the spun yarn that endanger the uniformity and the maintenance of the yarn fineness.

SUMMARY OF THE INVENTION

It is accordingly an object of the present invention to improve the feed presentation of sliver to the opening device in an open-end spinning device.

The present invention addresses this objective in an open-end spinning device basically comprising an opening device for opening continuously supplied sliver material, the opening device having a feed device for a rapidly running opening cylinder. According to the present invention, a sliver spreading device with at least one cooperating pair of spreading cylinders is arranged in front of the opening device in the feeding direction of the sliver material. The spreading cylinders have circumferential recesses between adjacent circumferential flanges and are arranged in parallel to one another with the flanges of each spreading cylinder engaging into the recesses of the opposing spreading cylinder, whereby the sliver material guided between the pair of spreading cylinders is spread in the axial direction in a cohesive manner over multiple recesses of the spreading cylinders.

In this manner, a sliver can be distributed uniformly over the entire working width of the opening cylinder by the spreading cylinders of the present invention arranged in front of the opening device. A relatively thin feed of fiber material can thereby be achieved. The sliver spreading device advantageously requires little space in comparison to multi-step drafting devices.

A feed of sliver material can be produced with the present invention which feed can achieve a more precise dosing and an elevated uniformity of the fed amount of sliver. The opening process itself is improved. Undesirably high drafts in the direction of sliver flow and the disadvantages associated with them can be avoided.

A compact device for the effective spreading of the sliver in the transversal direction in a narrow space is provided with the sliver spreading device of the present invention. A thin feed of sliver material for the opening cylinder can be achieved that extends over the entire working width of the opening cylinder. This makes it possible to achieve an unobjectionable opening process with a low speed of the opening cylinder and with an opening cylinder that is widened in comparison to the opening cylinder that is customary in rotor spinning. This unobjectionable opening process is distinguished by a high dosing exactitude and high yarn uniformity.

The spacing between the particular cooperating spreading cylinders can preferably be periodically varied. This allows the tensile stress acting on the feed of sliver material to be periodically varied and the spreading process to be intensified, accelerated and evened out in this manner.

In a preferred embodiment, two successive pairs of spreading cylinders are coupled to one another in such a manner that their spreading cylinder spacings vary in opposite directions, i.e., such that the spacing between one pair of spreading cylinders decreases as the spacing between the other pair of spreading cylinders increases. Preferably, the two spreading cylinder pairs are mechanically coupled and a common drive for producing the periodic variation of the cylinder interval is present, whereby the drive for the periodic varying of the spacings is particularly simple and economical and the spreading effect is reinforced even more. In this manner, a sliver can be spread, e.g., to two to three times the original sliver width.

The frequency of the periodic variation of the spreading cylinder spacings is preferably substantially higher than the rotational frequency of the spreading cylinders, e.g., the frequency may be preferably adjusted to a value between 8 Hz and 25 Hz, whereby a high uniformity of the spreading of the sliver material feed results.

The recesses can be designed as trapezoidal grooves. Such a form can be produced in a simple manner and forms deflection edges for the sliver guided in a zigzag manner between the particular cooperating spreading cylinders. The sliver is loaded between the deflection edges with an increasing tensile stress and is effectively spread under the action of this tensile stress.

Alternatively, the recesses and flanges are designed in such a manner that the flanges of the spreading cylinders form an approximate sinusoidal shape in the axial direction. A more protective spreading is achieved in this manner.

In an alternative embodiment of the invention, the spreading cylinders are formed by discs that are fastened to a shaft and whose circumferential surfaces form the flanges. This design can be produced in a simple and economical manner.

A limitation to a maximum of two slivers has the result that the sliver material feed will be stretched primarily by transverse spreading and not primarily by longitudinal draft to a thin fiber fleece when it is fed to the opening cylinder. This can improve the uniformity of the sliver material feed.

A deflection device in front of the sliver spreading device may be arranged at such a spacing for the sliver drawn out of a can that the sliver travels vertically between the can and the deflection device more than the length of one coil of the sliver in the can. This arrangement makes it possible that a false twist introduced into the sliver by the coiler rotation can turn itself out. Such false twists consist of so-called S twists and of so-called Z twists that can be randomly produced when the sliver is deposited. Thus, the deflection device associated with the sliver spreading device reliably avoids such false twists from running into the spreading cylinder pairs and hindering the spreading process.

Further details, features and advantages of the present invention are explained in the following description of a preferred embodiment with reference to the accompanying drawing figures.

DESCRIPTION OF THE PREFERRED EMBODIMENT

Figure 1:
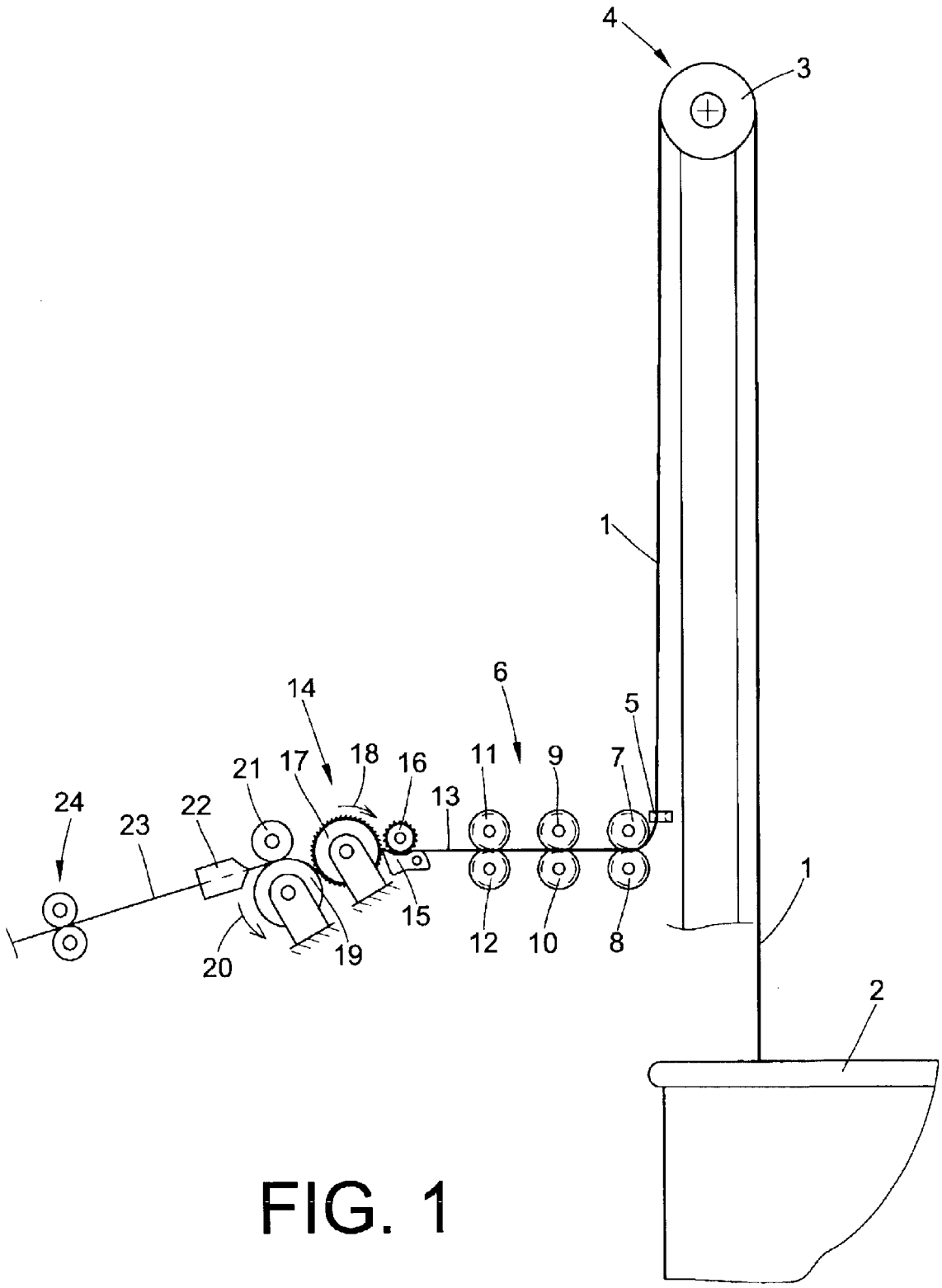
FIG. 1 is a schematic view of a spinning location with a sliver spreading device in accordance with a preferred embodiment of the present invention.

Referring now to the accompanying drawings and initially to FIG. 1, sliver 1 is drawn off out of can 2 at the spinning location shown in FIG. 1, travels via deflection roller 3 of deflection device 4 and is supplied by guide 5 to sliver spreading device 6. The spacing between the axis of deflection roller 3 and can 2 is somewhat more than the sliver length of one coiled rotation of the sliver stored within the can. Sliver 1 hangs freely on this stretch and false twists occurring in an isolated manner in sliver 1 can rotate themselves out. Sliver 1 runs through three pairs of cylinders formed by spreading cylinders 7, 8, 9, 10, 11, 12 and is fed in a spread state in the form of a thin sliver fleece 13 to opening device 14. Feed trough 15 presses spread sliver 1 against draw-in cylinder 16 and forms with draw-in cylinder 16 a clamping position that retains the end of sliver 1, the so-called sliver tuft. Opening cylinder 17 combs out the sliver tuft and opens the sliver to the individual fibers. Opening cylinder 17 thereby rotates in the direction of arrow 18. The fibers are taken by takeoff cylinder 19 standing under a vacuum and combined to a narrow, small sliver. The direction of rotation of takeoff cylinder 19 is indicated by arrow 20. Takeoff cylinder 19 and clamping roller 21 form a clamping line through which the small sliver is run.

Air spinning device 22 generates an air vortex that serves for sliver formation. Such air spinning devices are known, e.g., from German Patent Publication DE 196 10 960. Sliver 23 passes draw-off device 24 and is transported to a winding head not shown for reasons of simplicity.

Figure 2:
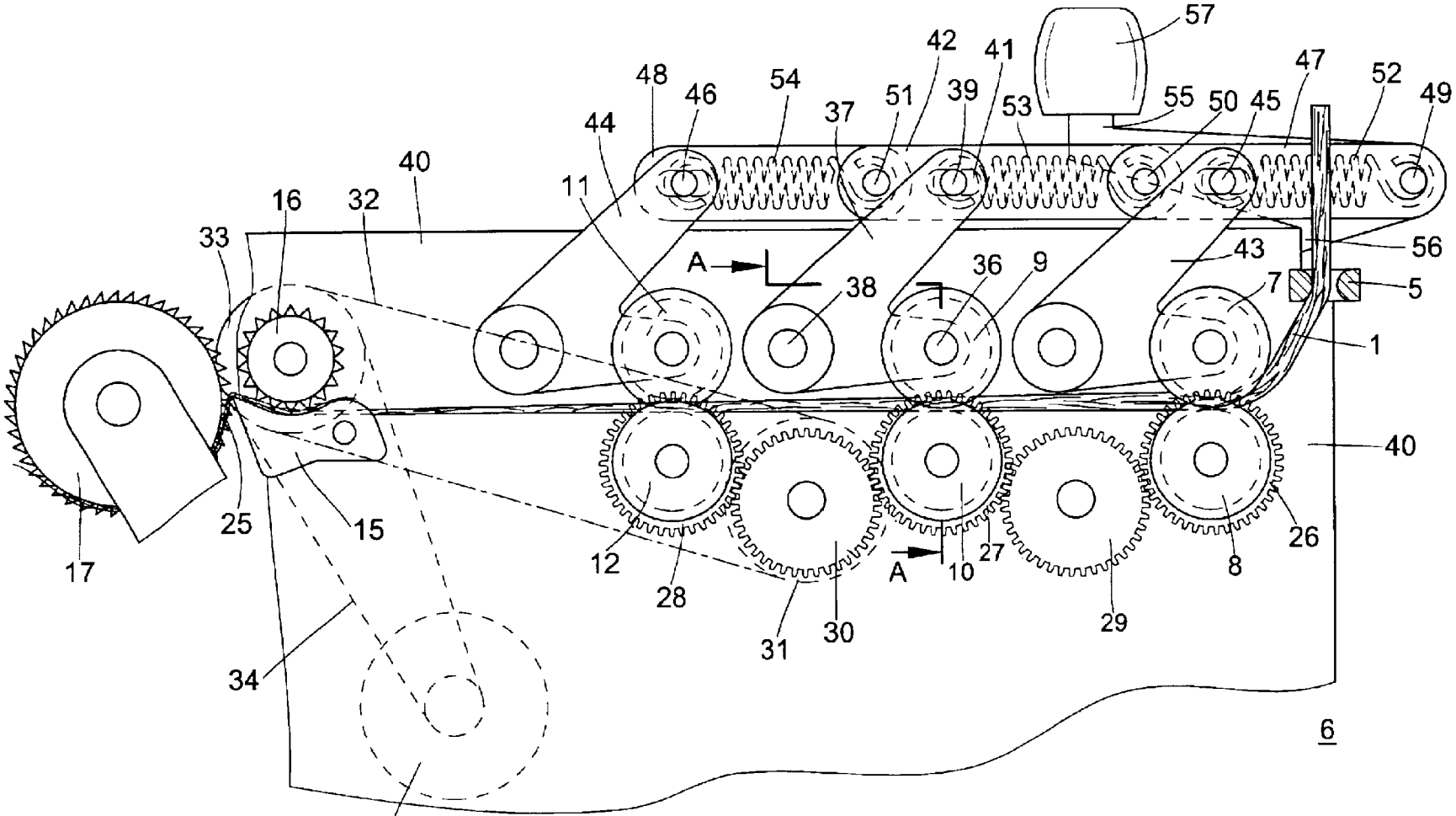
FIG. 2 is a simplified side view of the sliver spreading device of FIG. 1.

Sliver spreading device 6 of FIG. 2 is enlarged relative to FIG. 1 and is shown in more detail. Sliver 1 is deflected through guide 5 and drawn into the first cylinder pair formed by spreading cylinders 7, 8 and is spread thereby to become thinner as a result of the spreading. Sliver 1 subsequently travels through spreading cylinders 9, 10 of the second spreading cylinder pair and finally through spreading cylinders 11, 12 of the third spreading cylinder pair and is supplied as a thin sliver 1 spread over the entire working width to draw-in cylinder 16 that forms a clamping line with feed trough 15. A rapidly running opening cylinder 17 combs the fibers out of the end of sliver 1, which end is designated as sliver tuft 25, and opens sliver 1 thereby into individual fibers.

Lower spreading cylinders 8, 10, 12 are connected to gears 26, 27, 28 such that they rotate in unison with one another. Intermediate gears 29, 30 establish a drive connection between gears 26, 27, 28 of lower spreading cylinders 8, 10, 12. Intermediate gear 30 is connected to belt disk 31 such that it rotates in unison with it, which belt disk is driven by drive belt 32 via belt disk 33. Belt disk 33 is connected in turn to draw-in cylinder 16 such that it rotates in unison with it. Belt disk 33 is driven by motor 35 via drive belt 34. The translation between draw-in cylinder 16 and lower spreading cylinders 8, 10, 12 is selected in such a manner that the circumferential speed of draw-in cylinder 16 is equal to that of spreading cylinders 8, 10, 12.

Shaft 36 of upper spreading cylinder 9 is fastened to one arm of angle lever 37. Angle lever 37 can pivot about shaft 38, that is stationary relative to housing 40, and comprises bolt 39 fastened to the other arm. Bolt 39 engages into oblong hole 41 of coupling rod 42. In the same manner, upper spreading cylinders 7, 11 are pivotably supported on angle levers 43, 44. Bolts 45, 46 of angle levers 43, 44 also each engage into an oblong hole of coupling rods 47, 48.

Coupling rod 42 is pivotably inserted by its end onto bolt 45 and coupling rod 48 in the same manner onto bolt 39 so that the three angle levers 37, 43, 44 are articulated to each other and can pivot in common. Upper spreading cylinders 7, 9, 11 can be raised off of lower spreading cylinders 8, 10, 12 by pivoting angle levers 37, 43, 44 counterclockwise in order, e.g., to be able to insert new slivers.

Spiral springs 52, 53, 54 are suspended on bolts 45, 39, 46 of angle levers 43, 37, 44 and on bolts 49, 50, 51, that are fastened on coupling rods 47, 42, 48. If coupling rods 42, 47, 48 are drawn manually to the right in the view of FIG. 2 after the insertion of slivers, the oblong holes in coupling rods 42, 47, 48 shift relative to bolts 39, 45, 46, and bolts 39, 45, 46 and therewith angle levers 37, 43, 44 are loaded with a tractive force by means of spiral springs 52, 53, 54.

Under the action of this tractive force, angle levers 37, 43, 44 pivot clockwise until upper spreading cylinders 7, 9, 11 have reached an end position. In this end position coupling rods 42, 47, 48 are fixed by locking lever 55. Locking lever 55 can pivot about bolt 49 and has a nose 56 which engages in a hooking manner on housing 40.

In order to manually raise upper spreading cylinders 7, 9, 11, lever knob 57 is grasped and locking lever 55 is pivoted upward, as a consequence of which nose 56 is lifted out of housing 40 and the fixation of coupling rods 42, 47, 48 is cancelled. Angle levers 37, 43, 44 are pivoted counterclockwise and upper spreading cylinders 7, 9, 11 are raised by a subsequent moving of lever knob 57 to the left in the view of FIG. 2.

If a sliver thickening or sliver rotation travels into a spreading cylinder pair the upper spreading cylinders 7, 9, 11 can yield upwards. The deflection takes place counter to the tensile stress applied by the particular spiral springs 52, 53, 54 in the framework of the play limited by the dimensions of the oblong holes of coupling rods 42, 27, 48.

Figure 3:
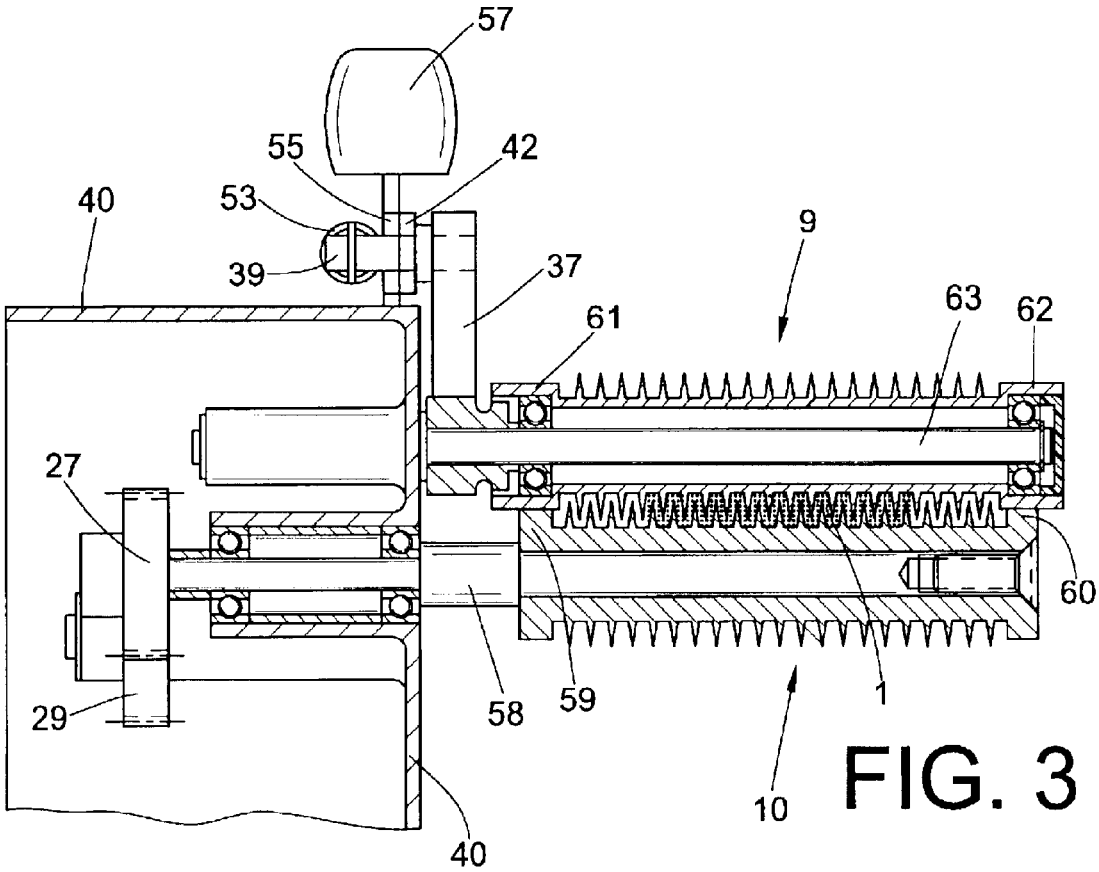
FIG. 3 is a cross-sectional view through a spreading cylinder pair of the sliver spreading device shown in FIG. 2, taken along line A—A thereof.

FIG. 3 shows a section through the second spreading cylinder pair of sliver spreading device 6 shown in FIG. 2. The grooves and flanges of the two spreading cylinders 9, 10 mesh into each other and form an intermediate space having a zigzag form. The spacing of spreading cylinders 9, 10 is dimensioned in such a manner that a sliver 1 of 7 ktex can be drawn into the intermediate space without raising upper spreading cylinder 9. Shaft 58 of lower spreading cylinder 10 is supported on housing 40 and is driven via gear 27. Spreading cylinder 10 comprises lateral edges 59, 60 on which upper spreading cylinder 9 rests with its edges 61, 62. Upper spreading cylinder 9 is rotatably supported on shaft 63. Shaft 63 is permanently connected to angle lever 37. Spiral spring 53 attacks bolt 39 fastened to the upper lever arm of angle lever 37. The working width of the cylinder pairs is adapted to the working width of draw-in cylinder 16. Sliver 1 is already extensively spread over the width of spreading cylinders 9, 10 in the view of FIG. 3. After the spreading by the third spreading cylinder pair, sliver 1 can be presented to draw-in cylinder 16 in a form spread over the entire working width thereof.

Figure 4:
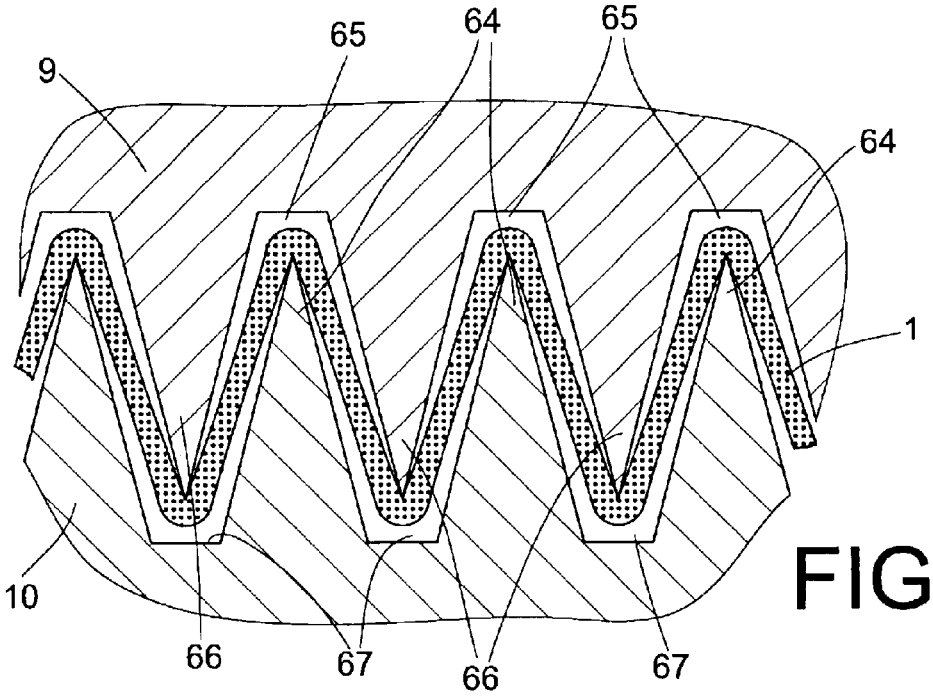
FIG. 4 is an enlarged cross-sectional view of the spreading cylinders of FIG. 3 showing the cooperative intermeshing thereof.

FIG. 4 shows the intermediate space between spreading cylinders 9, 10 in an enlarged view. Flanges 64 of lower spreading cylinder 10 engage into grooves 65 of upper spreading cylinder 9 and flanges 66 of upper spreading cylinder 9 engage into grooves 67 of lower spreading cylinder 10. Sliver 1 runs in a zigzag manner in the intermediate space between the two spreading cylinders 9, 10 and is subjected to a tensile stress upon running into the cylinder pair in the area between flanges 64 and flanges 66, which causes it to be spread.

Figure 5:
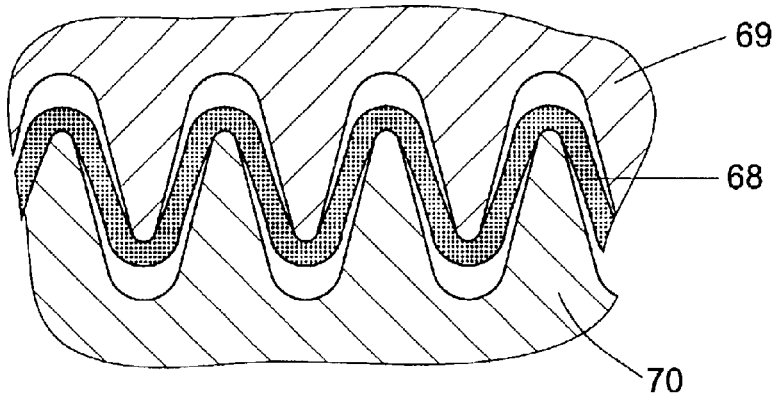
FIG. 5 is another enlarged cross-sectional view, similar to FIG. 4, through another embodiment of a pair of spreading cylinders with a sinusoidal profile.

The spreading process of sliver 68 can be completed in a more protective manner with the embodiment shown in FIG. 5. To this end, the surface of upper spreading cylinder 69 and the surface of lower spreading cylinder 70 have an approximately sinusoidal shape, viewed in the axial direction.

Figure 6:
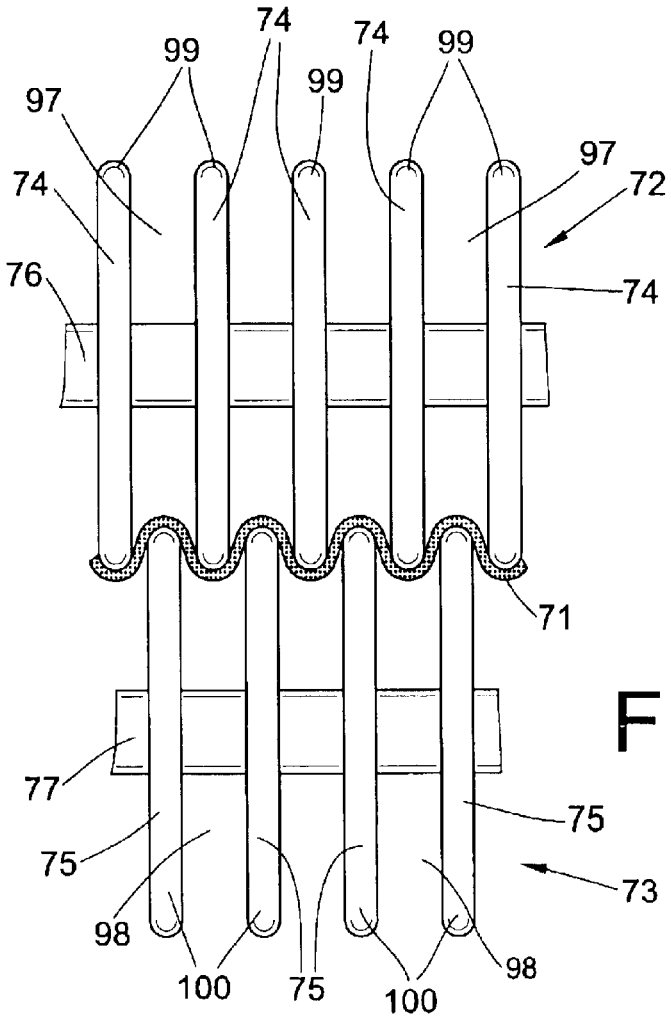
FIG. 6 is a cross-sectional view through another embodiment of a pair of spreading cylinders which comprise discs forming the flanges and recesses.

FIG. 6 shows an alternative embodiment of the subject matter of the invention. Sliver 71 is conducted through a spreading cylinder pair in which the upper spreading cylinder 72 as well as the lower spreading cylinder 73 comprise disks 74, 75 that are fastened to a shaft 76, 77 and whose circumferential surfaces form flanges 99, 100. Recesses 97, 98 are formed between disks 74, 75. This design of spreading cylinders 72, 73 can be manufactured simply and economically.

Figure 7:
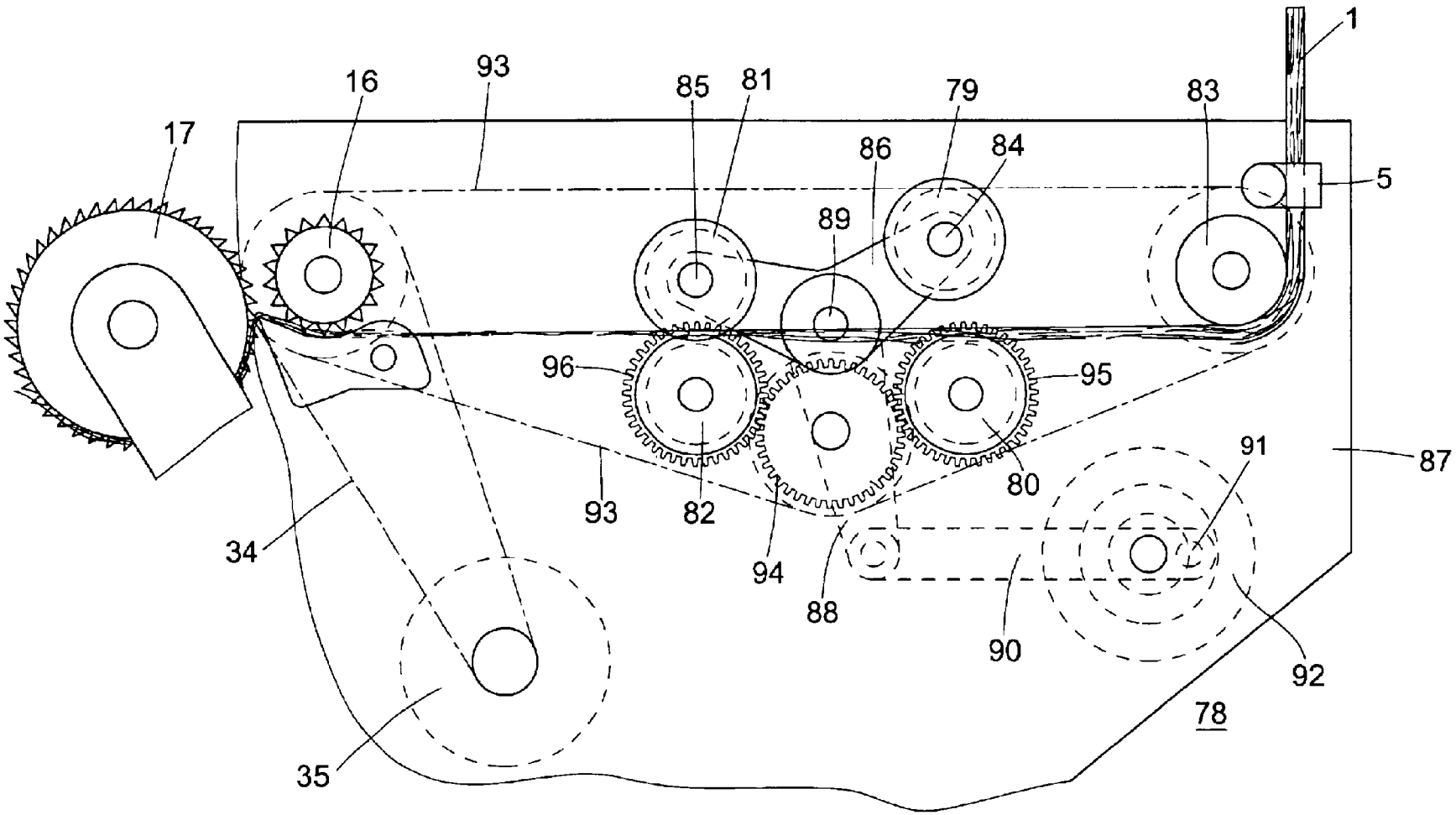
FIG. 7 is a side view of a sliver spreading device with cooperating spreading cylinders whose spacing from each other can be periodically varied.

FIG. 7 shows a side view of sliver spreading device 78 with upper spreading cylinders 79, 81 that move up and down and lower, stationary spreading cylinders 80, 82. The opening device with draw-in cylinder 16 is described above in conjunction with FIG. 2. Sliver 1 passes guide 5 and deflection cylinder 83 before it is fed to the first spreading cylinder pair formed by upper spreading cylinder 79 and lower spreading cylinder 80. Before it is presented to draw-in cylinder 16, the sliver 1 travels through a second spreading cylinder pair formed by upper spreading cylinder 81 and lower spreading cylinder 82. The height of the stationarily supported, lower spreading cylinders 80, 82 is selected in such a manner that sliver 1 can run above spreading cylinders 80, 82 when it is tautly drawn between deflection cylinder 83 and draw-in cylinder 16.

Shafts 84, 85 of spreading cylinders 79, 81 are fastened to angle lever 86. The two lower spreading cylinders 80, 82 are stationarily mounted on housing 87. The mounting corresponds to the mounting of spreading cylinders 8, 10, 12 shown in FIG. 2. Angle lever 86 and pivot lever 88 shown in dotted lines are connected to shaft 89 in such a manner that they rotate in unison with it and can pivot together about the axis of rotation of shaft 89. One end of pivot lever 88 can be moved back and forth by connecting rod 90. The other end of connecting rod 90 engages crank disk 91 driven by motor 92. The speed of crank disk 91 is between 500 rpm and 1,500 rpm. The crank drive is designed as a buffer element in such a manner that when sliver thickenings or sliver twists occur, no blockage occurs.

Upper spreading cylinders 79, 81 move periodically up and down as a function of the speed of crank disk 91. The spreading action exerted on sliver 1 is significantly reinforced by the high-frequency movement.

The lower spreading cylinders 80, 82 are put in rotation by drive belt 93 via intermediate gear 94 and gears 95, 96. Drive belt 93 also drives deflection cylinder 83. The translation ratios are selected so that deflection cylinder 83 as well as spreading cylinders 79, 80, 81, 82 and draw-in cylinder 16 have the same circumferential speed.

Sliver 1 is separated out of the grooves upon each upward movement of upper spreading cylinders 79, 81 in the particular spreading cylinder pair. The new contact position between sliver material and the flanges is usually shifted somewhat laterally during the downward movement of spreading cylinders 79, 81. Sliver 1 is spread as a result not only more effectively but also more uniformly.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An open-end spinning device comprising an opening device for opening continuously supplied sliver material, the opening device having a feed device for a rapidly running opening cylinder, and a sliver spreading device with at least one cooperating pair of spreading cylinders arranged in front of the opening device in the feeding direction of the sliver material, the spreading cylinders having circumferential recesses between adjacent circumferential flanges and being arranged in parallel to one another with the flanges of each spreading cylinder engaging into the recesses of the opposing spreading cylinder, whereby the sliver material guided between the pair of spreading cylinders is spread in the axial direction in a cohesive manner over multiple recesses of the spreading cylinders.

2. The open-end spinning device according to claim 1, wherein a spacing between the pair of spreading cylinders is variable periodically.

3. The open-end spinning device according to claim 2, wherein two successive pairs of spreading cylinder are coupled to one another such that the spacing between the spreading cylinders of each pair vary in opposite directions with the spacing of one pair of spreading cylinders decreases as the spacing between the other pair of spreading cylinders increases.

4. The open-end spinning device according to claim 3, wherein the two pairs of spreading cylinders are mechanically coupled and a common drive is provided for varying the spacings of the of the pairs of spreading cylinders.

5. The open-end spinning device according to claim 2, wherein the spacing of the spreading cylinders is varied according to a frequency which is substantially higher than a rotational frequency of the spreading cylinders.

6. The open-end spinning device according to claim 5, wherein the frequency of the periodic variation of the spacing of the spreading cylinders is adjusted to a value between 8 Hz and 25 Hz.

7. The open-end spinning device according to claim 1, wherein the recesses are formed as trapezoidal grooves.

8. The open-end spinning device according to claim 1, wherein the recesses and flanges are designed in such a manner that the flanges of the spreading cylinders form an approximately sinusoidal shape in the axial direction.

9. The open-end spinning device according to claim 1, wherein the spreading cylinders comprises disks that are fastened in parallel relation to each other to a shaft to form the flanges.

10. The open-end spinning device according to claim 1, wherein a deflection device for a coiled sliver drawn out of a can is arranged in front of the sliver spreading device and at a spacing from the can such that the sliver travels a vertical distance when drawn out of the can which is greater than the length of one coil of the sliver in the can.

* * * * *